US005109791A

United States Patent [19]

Matsumoto et al.

[11] Patent Number: 5,109,791

[45] Date of Patent: May 5, 1992

[54] FLOOR COATING LIQUID APPLYING MACHINE

[75] Inventors: Yasuhiko Matsumoto; Katsuaki Nanba; Isao Morita, all of Osaka, Japan

[73] Assignee: Penguin Wax Co., Ltd., Osaka, Japan

[21] Appl. No.: 544,755

[22] Filed: Jun. 26, 1990

[30] Foreign Application Priority Data

May 16, 1990 [JP] Japan ..... 2-127356
May 16, 1990 [JP] Japan ..... 2-127357

[51] Int. Cl.[5] ..... B05C 11/06

[52] U.S. Cl. ..... 118/63; 118/108; 118/109; 118/207; 118/305

[58] Field of Search ..... 118/62, 63, 108, 109, 118/120, 207, 256, 266, 305; 15/98, 50.1, 50.2, 320

[56] References Cited

U.S. PATENT DOCUMENTS

| | | | |
|---|---|---|---|
| 2,995,469 | 8/1961 | Le Claire | 118/63 X |
| 3,441,969 | 5/1969 | Dix et al. | 15/98 |
| 3,678,890 | 7/1972 | Ehrensing et al. | 118/63 |
| 4,240,583 | 12/1980 | Hughes | 239/157 |
| 4,401,253 | 8/1983 | O'Rourke | 118/63 X |
| 4,471,713 | 9/1984 | Cote et al. | 118/108 |
| 4,831,958 | 5/1989 | Selby | 118/305 X |
| 4,910,824 | 3/1990 | Nagayama et al. | 118/109 X |

FOREIGN PATENT DOCUMENTS

| | | |
|---|---|---|
| 2571986 | 4/1986 | France . |
| 63-315169 | 12/1988 | Japan . |

*Primary Examiner*—Richard L. Chiesa
*Attorney, Agent, or Firm*—Gifford, Groh, Sprinkle, Patmore and Anderson

[57] ABSTRACT

A floor coating liquid applying machine having a propelling machine body, a liquid feed device driven to reciprocate along a transverse direction of the machine body and a liquid feed pump. The feed pump includes an elastic pump tube connecting between a liquid tank and the liquid feed device, a rotary pump member operatively connected with the elastic pump tube, a feed portion disposed along a rotational direction of the rotary pump member, with the feed portion being operable in response to rotation of the rotary pump member for causing the elastic pump tube to elastically deform to squeeze out the liquid therein into the liquid feed device and a receiver portion disposed aside the feed portion for causing the elastically deformed pump tube to resile so as to introduce further liquid from the tank into the elastic pump tube. Also, a blower opening is provided rearwardly of an applying member for feeding to the floor face hot air at about 30 to 90 degrees in Celsius and at the velocity of about 40 to 100 m/sec.

11 Claims, 7 Drawing Sheets

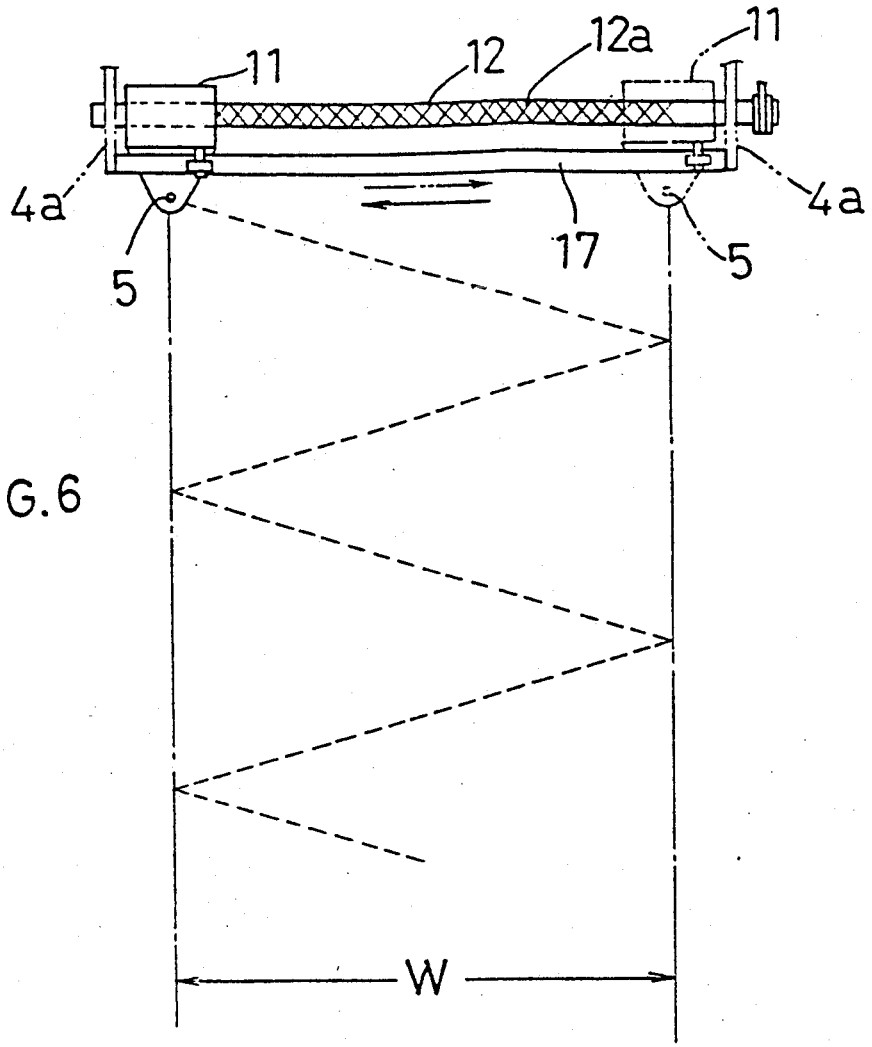
FIG. 6
FIG. 7
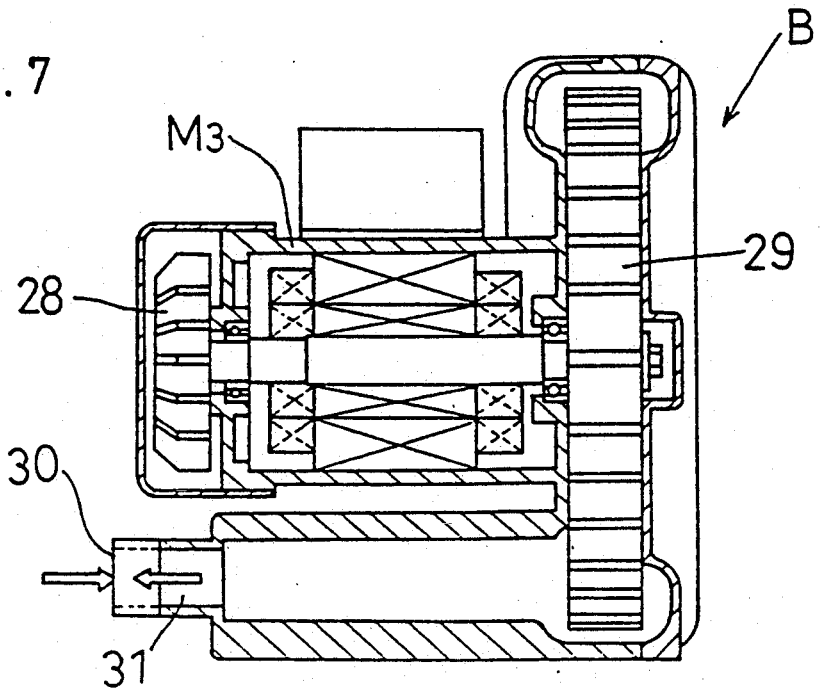

FLOOR COATING LIQUID APPLYING MACHINE

BACKGROUND OF THE INVENTION

1 FIELD OF THE INVENTION

The present invention relates to a floor coating liquid applying machine having a propelling machine body, a liquid feed device mounted on the machine body for feeding floor coating liquid to a floor surface and a feed pump attached to the liquid feed device for feeding the floor coating liquid from a liquid tank.

2 DESCRIPTION OF THE RELATED ART

A floor coating liquid applying machine of the above-noted type is known from e.g. a Japanese patent application gazette No. 1-240353. In this machine, a plurality of feed nozzles, comprising liquid feed devices, are disposed side by side in the transverse direction of the machine body and a liquid feed pump of a fixed delivery type is employed for distributing floor coating liquid from a liquid tank to the feed devices, so that the coating liquid can be uniformly applied onto an entire surface of a predetermined width corresponding to a travelling passage of the machine body.

The problem with the above machine is that it takes a long time to dry the applied floor coating liquid.

That is, for preventing clogging by the liquid, each of liquid passages respectively extending to the feed nozzles has a relatively large cross section. Accordingly, it is difficult to restrict the amount of liquid discharged through the nozzle. Further, restriction of amount of discharged liquid is also difficult for the fixed delivery pump because of its structural and designing limitations. Consequently, with this conventional machine, the amount of floor coating liquid applied to the floor per unit area tends to be excessive. This means that the machine consumes a large amount of liquid to treat a floor surface of a fixed area and also that the drying operation of the liquid takes a long time.

As to the second-mentioned problem, the prior art has suggested use of a heater incorporated in an applying member for promoting drying of the liquid by heat discharged thereby (Japanese laid-open patent gazette No. 63-315169).

However, this machine still has some room for improvement also. First, the finish of the treated floor tends to be poor because contact between the heater member and the floor surface interferes with development of glossiness and water evaporation of the coating liquid. Second, the machine can not yet achieve significant speed-up of drying operation.

Taking the above state of the art into consideration, the primary object of the present invention is to provide an improved floor coating liquid applying machine which can feed a proper amount of floor coating liquid while effectively avoiding clogging of liquid passage by the liquid thereby to provide good floor finish and to significantly speed up the drying operation of the applied liquid.

SUMMARY OF THE INVENTION

For accomplishing the above-noted object, a floor coating liquid applying machine is provided and includes: a propelling machine body; a liquid feed device movably mounted on the machine body for feeding floor coating liquid to a floor surface; a liquid applying member attached to the machine body for applying the floor coating liquid onto the floor surface; a feed pump attached to the liquid feed device for feeding the floor coating liquid from a liquid tank; the liquid feed device being driven to reciprocate along a transverse direction of the machine body; the feed pump including, an elastic pump tube connecting between the tank and the liquid feed device, a rotary pump member operatively connected with the elastic pump tube, a feed portion disposed along a rotational direction of the rotary pump member, the feed portion being operable in response to rotation of the rotary pump member for causing the elastic pump tube to elastically deform to squeeze out the liquid therein into the liquid feed device and a receiver portion disposed aside the feed portion for causing the elastically deformed pump tube to resile so as to introduce further liquid from the tank into the elastic pump tube.

Functions and effects of the above-described construction will be described next.

As is the case with the conventional machine, the reciprocating stroke of the liquid feed device is so set as to equate with a predetermined width of area to be treated with the coating liquid and the applying member is provided with an applying width greater than the predetermined width of the area to be treated. Then, as the vehicle body travels, the liquid feed device also makes a longitudinal advance together with the vehicle body and makes at the same time a reciprocating transverse movement across the vehicle body. With these longitudinal and reciprocating transverse motions combined, the liquid feed device can apply the coating liquid in the pattern of zigzag onto the predetermined width of the floor surface on which the machine body is travelling. Compared with the previously described, conventional arrangement where a plurality of liquid feed nozzles are disposed side by side along the transverse direction of the machine body, the construction of the present invention is advantageous in that even a smaller number (e.g. only one) of feed nozzle can suffice to uniformly apply the coating liquid to the floor surface. Then, with the reduced number of feed nozzles being sufficient, the liquid passage to the nozzle(s) can be relatively large in section for preventing liquid clogging therein without increasing the amount of liquid fed by the entire machine more than necessary. Consequently, it becomes possible to restrict the amount of liquid applied per unit area of the floor surface for a fixed discharge amount of the liquid feed device.

Moreover, at the feed pump, as the rotary pump member is rotatably driven, this rotary motion causes the feed portion and the receiver portion to elastically deform and resile the elastic tube alternately with each other, whereby the feeding operation of the liquid takes place intermittently. And, the amount of the discharged liquid can be readily controlled by properly setting the thickness of the elastic tube and also the feeding pitch. Thus, compared with the conventional pump, the liquid discharge amount can be conveniently set at a smaller value than the lower limit of the conventional machine.

As described above, according to the machine of the present invention having the feature of liquid feed device capable of zigzagging motion and the elastic tube, it has become possible to feed just enough amount of coating liquid, elimitating waste of the liquid and quickening the subsequent drying operation of the liquid.

Further, compared with the conventional machine which feeds the liquid by spraying, the machine of the present invention is advantageous for reduced possibility of liquid clogging problem, more uniform feeding of the liquid and for resultant, better finish condition.

Advantageously, a blower opening is provided at a position on the machine body rearwardly of the liquid applying member with respect to a propelling direction of the vehicle body, the blower opening being operable to feed therethrough hot air of about 30 to 90 degrees in Celsius onto the floor surface at a velocity of about 40 to 100 m/sec.

As described hereinbefore, in the conventional machine, the heater is incorporated in the liquid applying member. Thus, drying, i.e. evaporation of the applied liquid tends to be interferred with by the presence of the applying member surrounding the heater, which presence blocks proper escape of the evaporation of the water content in the liquid. Thus, the amount of heat tends to be either excessive or insufficient. In the former case, the evaporation and plasticizing of the coating liquid will be insufficient while in the latter case the curing of the same will be delayed. Then, with the above additional feature of the present invention, feeding of the hot air is carried out separately of the liquid feeding operation and therefore is not interferred with by the same. Accordingly, the hot air discharged through the blower opening, which is disposed rearwardly and separately of the liquid applying member, will quickly and properly dry the liquid applied by the liquid applying member and render the applied liquid glossy. Also, the defined velocity (i.e. about 40 to 100 m/sec.) of the air flow can advantageously prevent unevenness in the cured surface of the coating liquid.

With the above features combined, the present invention has fully achieved the intended object of providing an improved floor coating liquid applying machine which can feed a proper amount of floor coating liquid while effectively avoiding clogging of liquid passage by the liquid thereby to provide good floor finish and to significantly speed up the drying operation of the applied liquid.

Further and other objects, features and effects of the invention will become more apparent from the following more detailed description of the embodiments of the invention with reference to the accompanying drawings.

BRIEF DESCRIPTION OF THE DRAWINGS

Accompanying drawings illustrate a preferred embodiment of a floor coating liquid applying machine relating to the present invention; in which, FIG. 6 is a plane view showing a transverse feeding construction of a liquid feed device, FIG. 7 is a section view showing an electric blower.

DESCRIPTION OF THE PREFERRED EMBODIMENTS

Preferred embodiments of a floor coating liquid applying machine relating to the present invention will be particularly described next with reference to the accompaying drawings.

Figure 1:
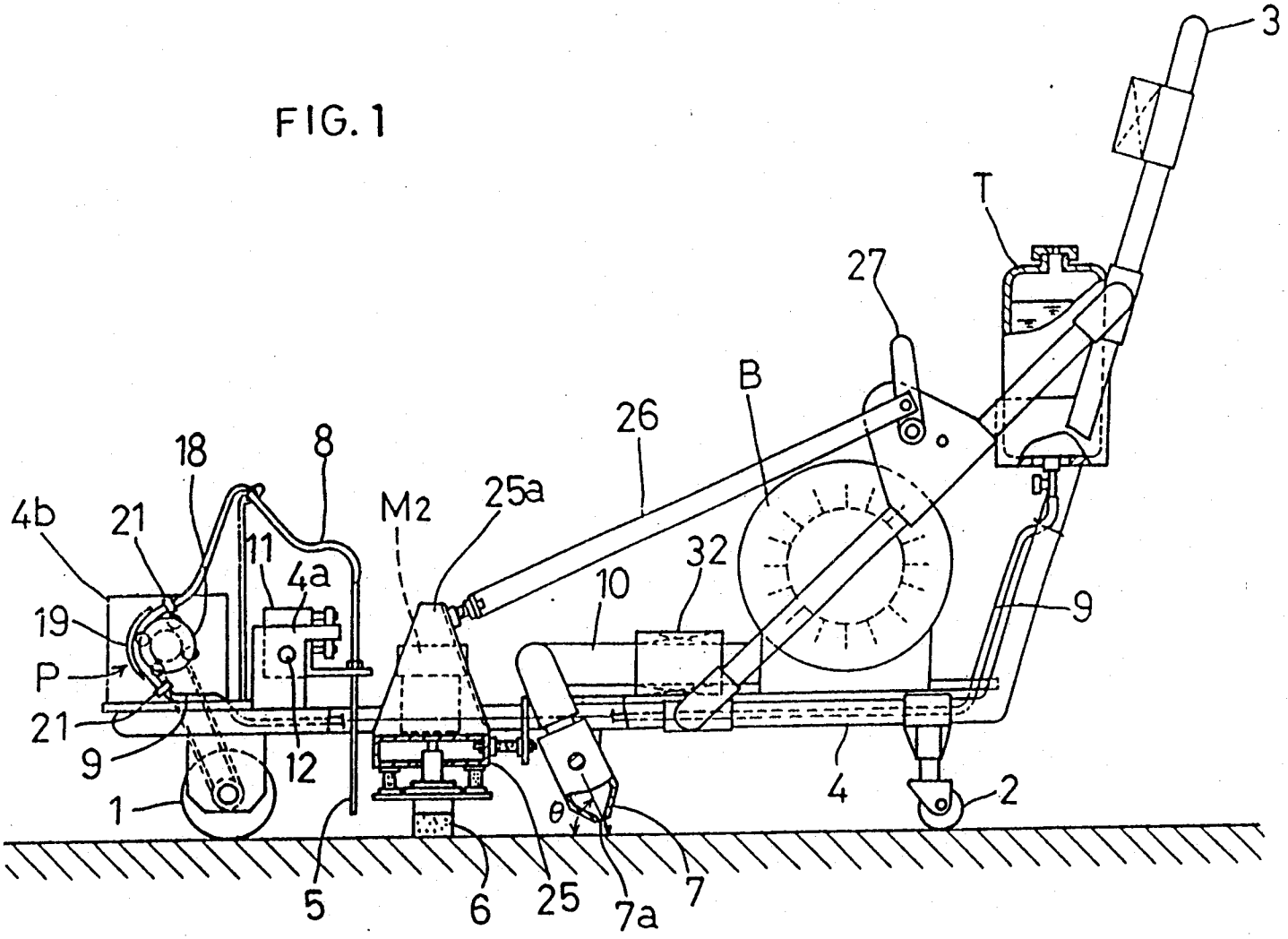
FIG. 1 is a partially cutaway side view showing the entire machine.

As shown in FIG. 1, a floor coating liquid applying machine includes a pair of right and left front wheels 1, 1 driven by an electric motor M1, a pair of right and left rear wheels 2, 2 of a caster type, a propelling machine body 4 having a steering handle 3, a liquid feed nozzle 5 as a liquid feed device, an applying member 6 and an air feed member 7 attached to positions between the front and rear wheels. The liquid feed nozzle 5 is connected through a nozzle feed tube 8, a liquid feed pump P and a tank feed tube 9 with a coating liquid tank T which is mounted at a base of the steering handle 3. Also, the air feed member 7 is connected through an air feed pipe 10 with an electric blower B which is mounted at a rear portion of the propelling vehicle body 4. The tank T is to contain therein a floor coating liquid including thermoplastic resin type coating liquid having properties shown in Table 1. Then, in operation, as the vehicle body is propelled on a floor face made of wood, stone, concrete or any other chemical, the machine feeds the coating liquid onto the floor surface and then drying the same by a predetermined width substantially corresponding to a width of the propelling passage of the vehicle body.

Figure 2:
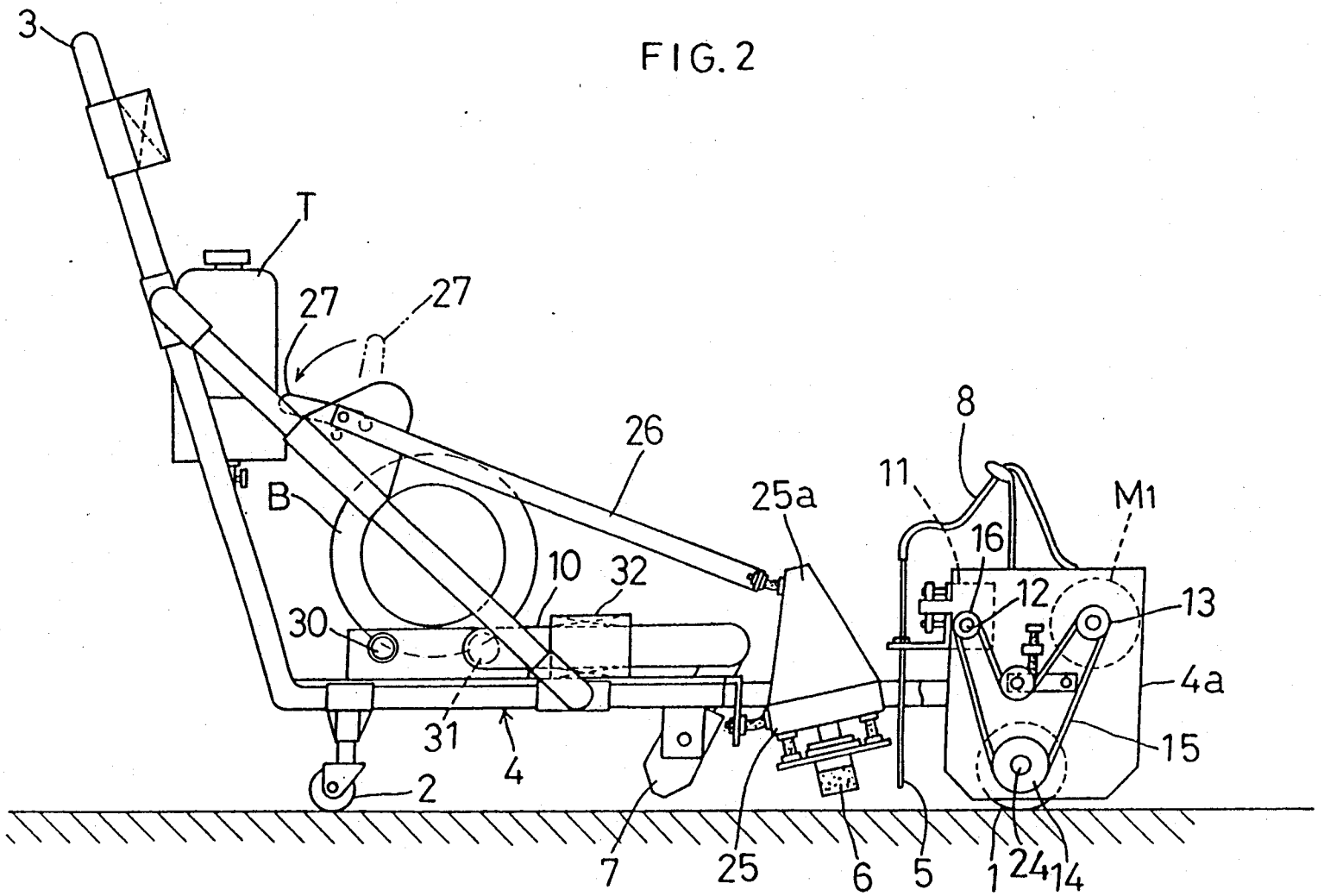
FIG. 2 is a side view of the entire machine.
Figure 3:
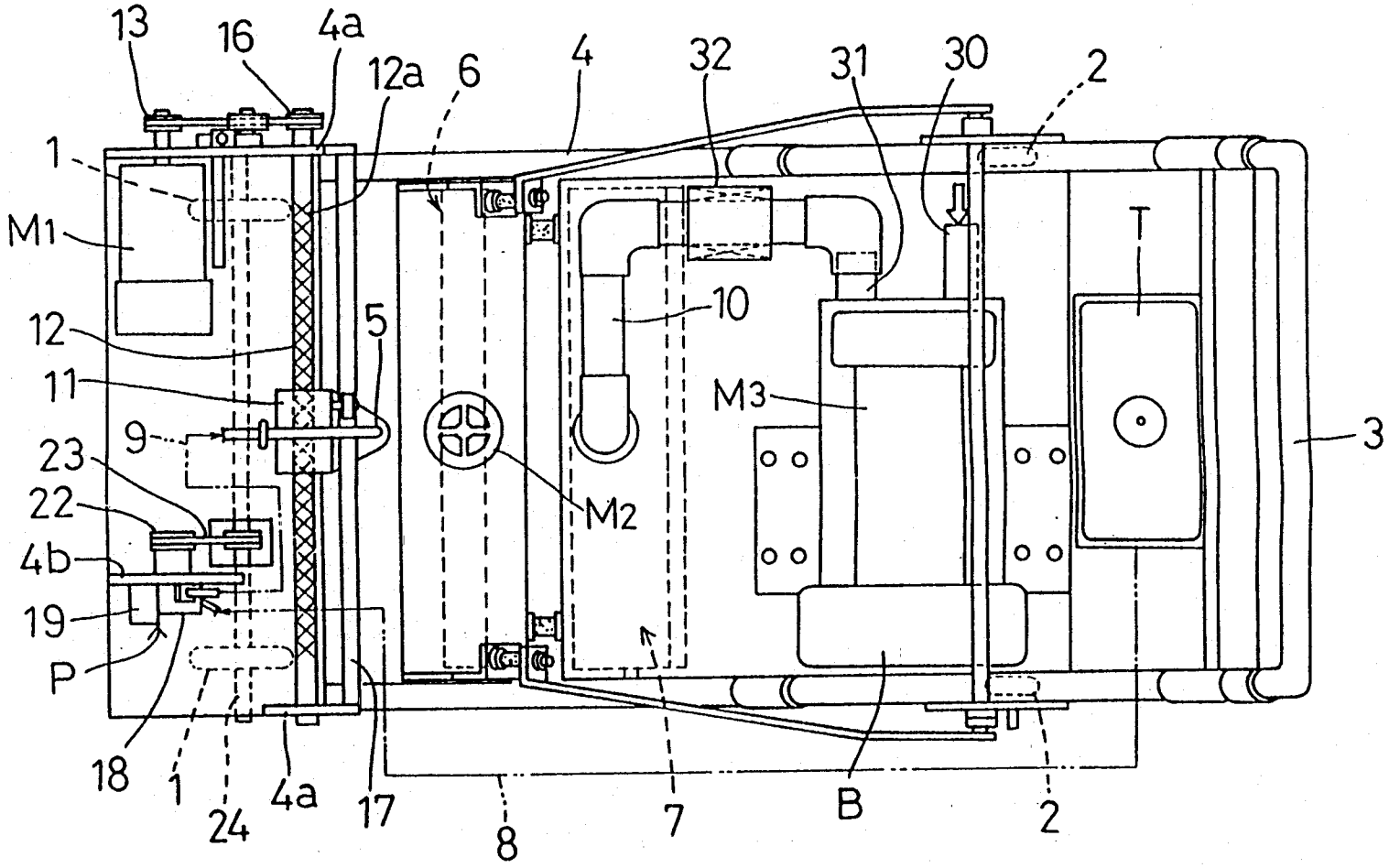
FIG. 3 is a plane view of the entire machine.

As shown in FIG. 3, the liquid feed nozzle 5 comprises a metal tube and is mounted at a reciprocable casing 11. The casing 11 is reciprocably mounted on a transverse rotary shaft 12 which is supported to and between a pair of right and left support stays **4*a*, 4*a* attached to the vehicle body 4. Further, as shown now in FIG. 2, the transverse rotary shaft 12 mounts, at a distal end thereof to, a drive pulley 16. And, this driven pulley 16 is driven by the electric motor M1 through a belt transmission assembly including the pulley 16 per se, an output pulley 13 of the motor M1, a front-wheel drive pulley 14 and a transmission belt 15 entrained around these pulleys, such that the electric motor M1 drives the transverse rotary shaft 12 as well as the front wheels 1. The support stays 4*a* rotatably support the transverse rotary shaft 12 and this shaft 12 defines in its periphery a spiral groove 12*a* cooperable with an unillustrated transverse feed mechanism incorporated in the reciprocable casing 11, so that the casing 11 effects a reciprocating motion transversely of the vehicle body 4 along the rotary shaft 12 and along a guide rail 17 adapted also for preventing rotation of the casing 11. Consequently, the liquid feed nozzle 5 is driven by the motor M1 to reciprocate transversely of the vehicle body 4 for a stroke determined by a length of the spiral groove 12*a*. Next, the construction of the liquid feed pump P will be described with reference to FIGS. 1 and 4**.

A rotary pump member 18 and a curved plate 19 positioned forwardly of the vehicle body with respect to the rotary pump member 18 are mounted on a pump support stay **4*b*. Further, between the rotary pump member 18 and the curved plate 19, there is positioned an intermediate portion of an elastic pump tube 20, with the tube 20 being attached to the stay 4*b* through a pair of tube support elements 21, 21. The elastic tube 20 has its one distal end connected with the tank feed tube 9 and its other distal end connected with the nozzle feed tube 8, respectively, so that the tank T and the feed nozzle 5 are connected with each other via the elastic tube 20. In operation, as the rotary pump member 18 is driven to rotate on an axis X, the floor coating liquid is withdrawn from the tank T through the tank feed tube 9 and then supplied to the liquid feed nozzle through the nozzle feed tube 8**.

Figure 4:
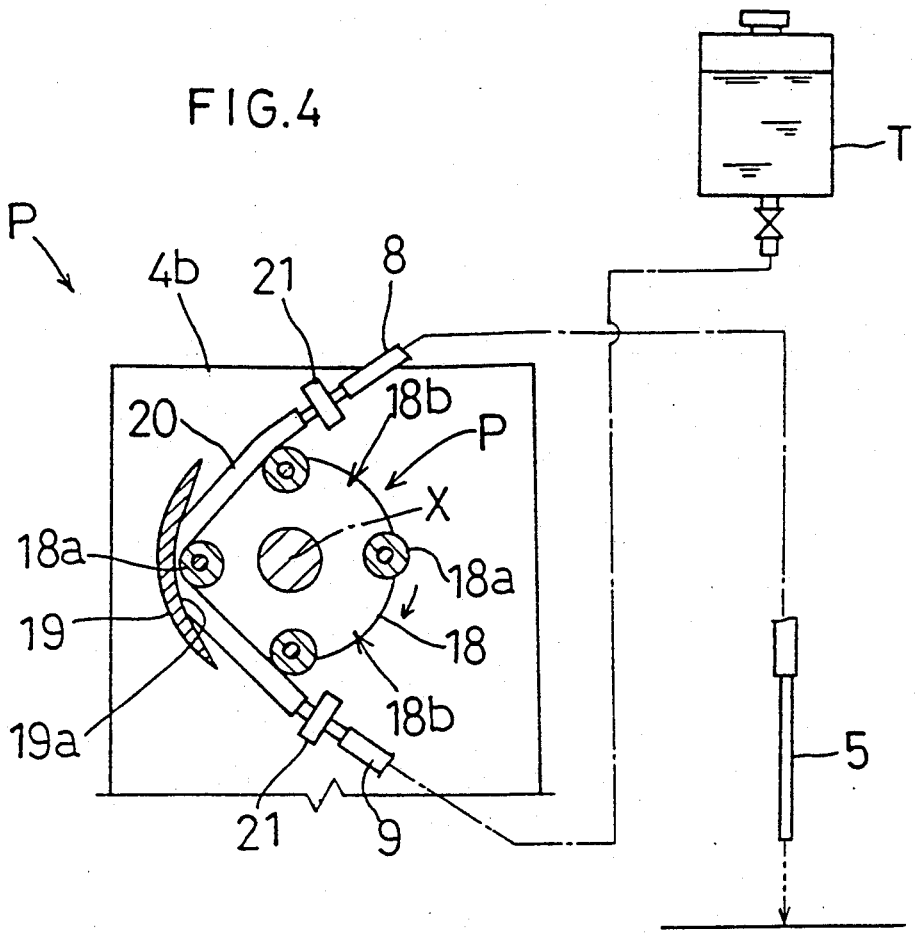
FIGS. 4 and 5 are section views of a liquid feed pump.
Figure 5:
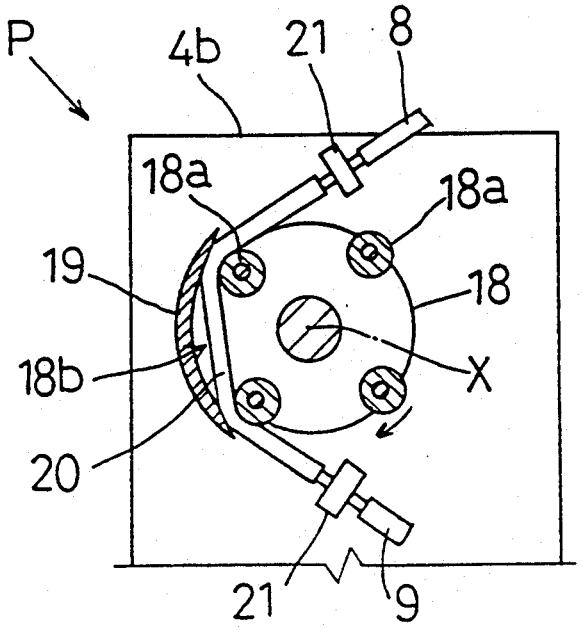

More particularly, as shown in FIG. 3, on the other side of the rotary pump member 18 as opposed with respect to the pump support stay 4*b*, there is disposed a pump drive pulley 22 which is operatively connected with a shaft 24 for front wheels 1 via a belt transmission member 23, such that the rotary pump member 18 is driven by the electric motor M1 in operative connection with the front wheels 1. Referring back to FIG. 4, the rotary pump member 18 includes a plurality of feed portions 18*a* each comprising a roller made of resin material, with the feed portions 18*a* being dispersed along the rotational periphery of the rotary pump member 18 and also with a plurality of receiving portions 18*b* being formed between each adjacent pair of feed portions 18*a*. Accordingly, the feed portions 18*a* and the receiving portions 18*b* are positioned alternately with each other in the rotational direction of the rotary pump member 18. Then, as the rotary pump member 18 is driven to rotate on the axis X, the feed portions 18*a* and the receiver portions 18*b* alternately come into opposition with a lateral face of the intermediate portion of the elastic tube 20 against a tube-receiving face 19*a* of the curved plate 19. More specifically, as shown in FIG. 4, when one feed portion 18*a* comes into opposition, i.e. pressure contact, in this case, with the tube face, thereby elastically deforming this portion of the tube 20 to squeezingly feed the coating liquid at this tube portion through the nozzle feed tube 8 to the liquid feed nozzle 5. This is the liquid discharging condition. On the other hand, as shown in FIG. 5, when one receiver portion 18*b* comes into opposition with the intermediate portion of the elastic tube 20, this deformed elastic tube portion resiles to its original shape, and this resiling action of the tube serves to introduce further liquid from the tank T. This introduction is caused by the negative pressure inside the tube 20 resulting from the resiling action of the same and also by the falling of the liquid due to its weight reserved at the tank T. Thereafter, the machine is ready for a next liquid discharge operation which takes place with the next (with respect to the rotational direction of the rotary member 18) feed portion 18*a* comes into pressure contact with the intermediate tube portion. In this way, the machine can effect intermittent liquid feeding operation. And, the discharging interval and liquid amount of this intermittent liquid feeding operation can be advantageously and conveniently controlled by appropriately varying the disposing pitch of the feed portions 18*a*, rotational speed of the rotary pump member 18 and the inner diameter of the elastic tube 20 and so on.

Summarizing the above-described functions, as the electric motor M1 propels the vehicle body 4 and also causes the liquid feed nozzle 5 to reciprocate transversely of the vehicle body, as illustrated in FIG. 6, the feed nozzle 5 feeds a predetermined discharge amount (shown in Table 2) of the floor coating liquid in the zigzagging pattern to the floor face within the width W determined by the reciprocating stroke of the nozzle 5.

On the other hand, as shown in FIGS. 2 and 3, the liquid applying member 6 is disposed rearwardly of the liquid feed nozzle 5 with regard to the advancing direction of the vehicle body 4. This applying member 6 is operatively connected through a drive device 25 with a further electric motor M2 mounted on the vehicle body 4, so that driving force of the motor M2 causes, via the drive device 25, to both rotate and vertically oscillate the liquid applying member 6 relative to the floor face. More particularly, the drive device 25 for the liquid applying member 6 is operatively connected through a frame portion 25*a* and a link member 26 with a switching lever 27 attached to the steering handle 3. Then as this switching lever 27 is pivotably operated, the liquid applying member 6 can be selectably moved into contact with or away from (i.e. lifted up) the floor face. The lowered condition is the operative condition while the lifted-up condition is the inoperative, storage condition. In the former condition, the liquid applying member 6 moves along the propelling vehicle body to apply the floor coating liquid discharged by the liquid feed nozzle 5 uniformly on the floor face by the set width W.

Referring now to FIG. 7, the electric blower B includes a blade wheel 29 rotatably driven by means of a further electric motor M3 which is cooled by a cooling fan 28. As the blade wheel 29 is rotated, ambient air is introduced through an air intake opening 30, and this air is supplied via an air passage 10 through an outlet opening 31 to the air feed member 7. Further, at an intermediate portion of the air passage 10, there is provided an electic heater 32 (see FIG. 3) for heating the air passing through the passage 10. Also, the air feed member 7 has, at its leading end, a blower opening 7*a* comprising a slit having a width substantially equal to the set width W. And, this air feed member 7 is disposed rearwardly of the liquid applying member 6 with respect to the propelling direction of the vehicle body 4. Accordingly, the hot air fed through the blower opening or slit 7*a* can effectively and uniformly dry the floor face treated with the applying member 6. Consequently, with these functions combined, the machine, as being propelled, can speedily apply the floor coating liquid, cure the applied liquid and then dry the same continously.

TABLE 1

| properties of floor coating liquid | |
|---|---|
| appearance: | whitish semi-transparent emulsion |
| pH value: | 8.20 (20 degrees Celsius) |
| non-volatile content (%): | 20.3 |
| viscosity (cps): | 3.5 |
| coagulation point (°C.): | 0 |

TABLE 2

| | |
|---|---|
| vehicle propelling speed (m/min.): | 10 to 30 |
| coating liquid feed amount (g/m$^2$): | 3.4 |

TABLE 3

| air velocity m/sec. | air temperature Celsius | drying condition ○: good Δ: poor |
|---|---|---|
| 20 | 30 | Δ |
| | 90 | ○~Δ |
| 40 | 30 | Δ |
| | 60 | ○ |
| 60 | 30 | Δ |
| | 56 | ○ |
| 80 | 30 | ○ |
| | 52 | ○ |
| 100 | 30 | ○ |
| | 45 | ○ |
| test condtions: | | |
| room temperature (Celsius): | | 16 to 26 |

TABLE 3-continued

| | |
|---|---|
| humidity (%): | 43 to 70 |
| floor face temperature (Celsius): | 13 to 18 |
| vehicle propelling speed (m/sec): | 10 |

Figure 8:
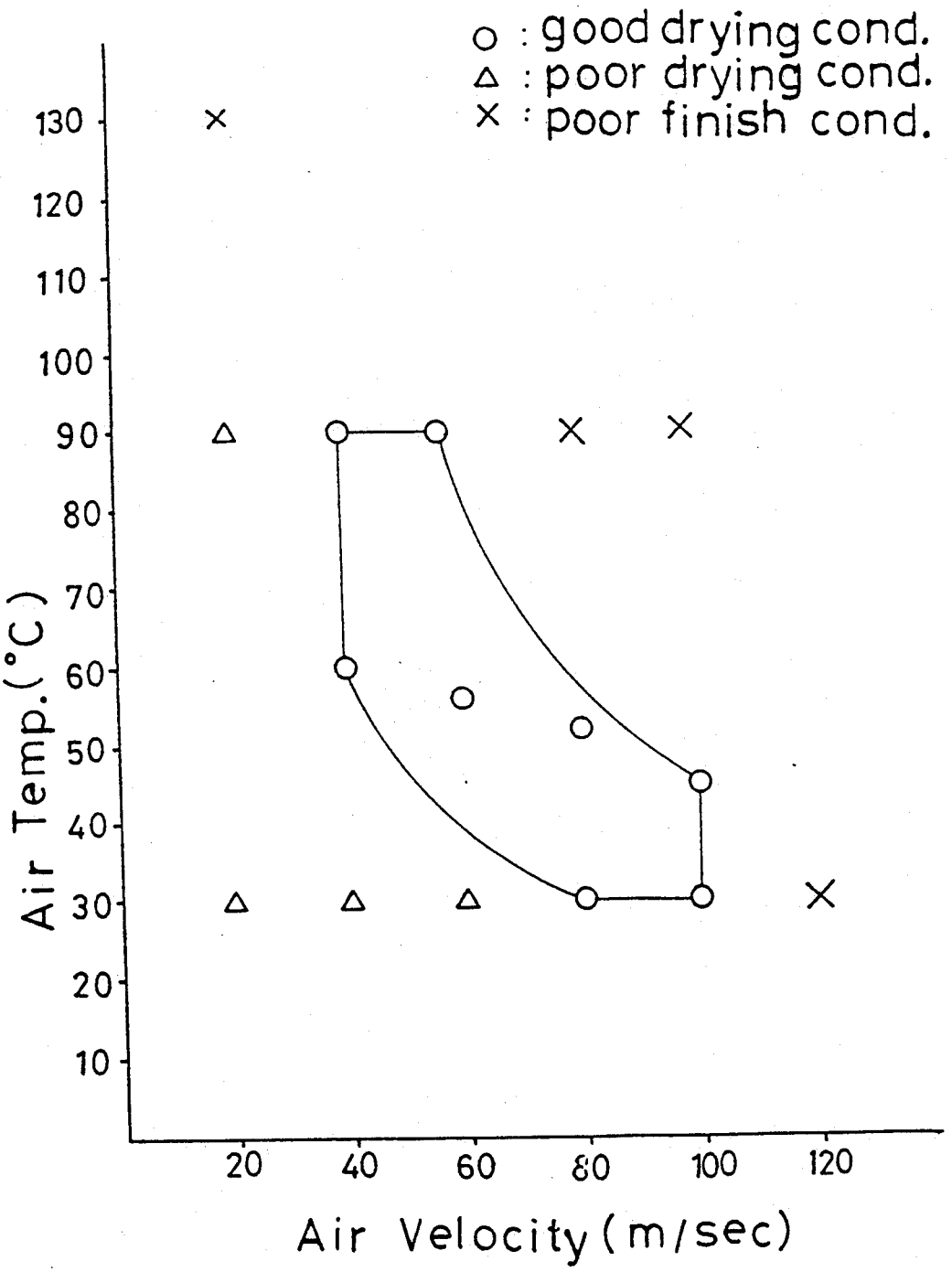
FIG. 8 is a view illustrating results of experiments on the temperature and air flow speed of the feed air flow.

Based on the tests of temperature and air velocity shown in the above Table 3 and also in a graph of FIG. 8, the electric blower B, the electric heater 32, the blower opening *7a* and so on are so set as to provide the hot air of the temperature ranging between about 30 and 90 in Celsius and at the air velocity ranging between about 40 and 100 m/sec.

Incidentally, circle, triangle and cross marks in FIGS. 3 and 8 denote various finish or drying conditions at the vehicle propelling speed of 10 m/min, with the circle mark denoting a good drying condition, the trangle mark denoting a poor drying condition and the cross mark denoting a poor finish, i.e. gloss condition regardless of the drying condition, respectively.

The poor performance denoted by the cross marks of FIG. 8 can be readily anticipated from the test results of Table 3 .

The blower openings *7a* is set at a height H of about 5 to 15 mm and with an inclination ($\theta$) relative to the floor face, thus the air is fed through the opening *7a* towards the rear end of the vehicle body 4. These settings are based on the test results of FIG. 9.

Figure 9:
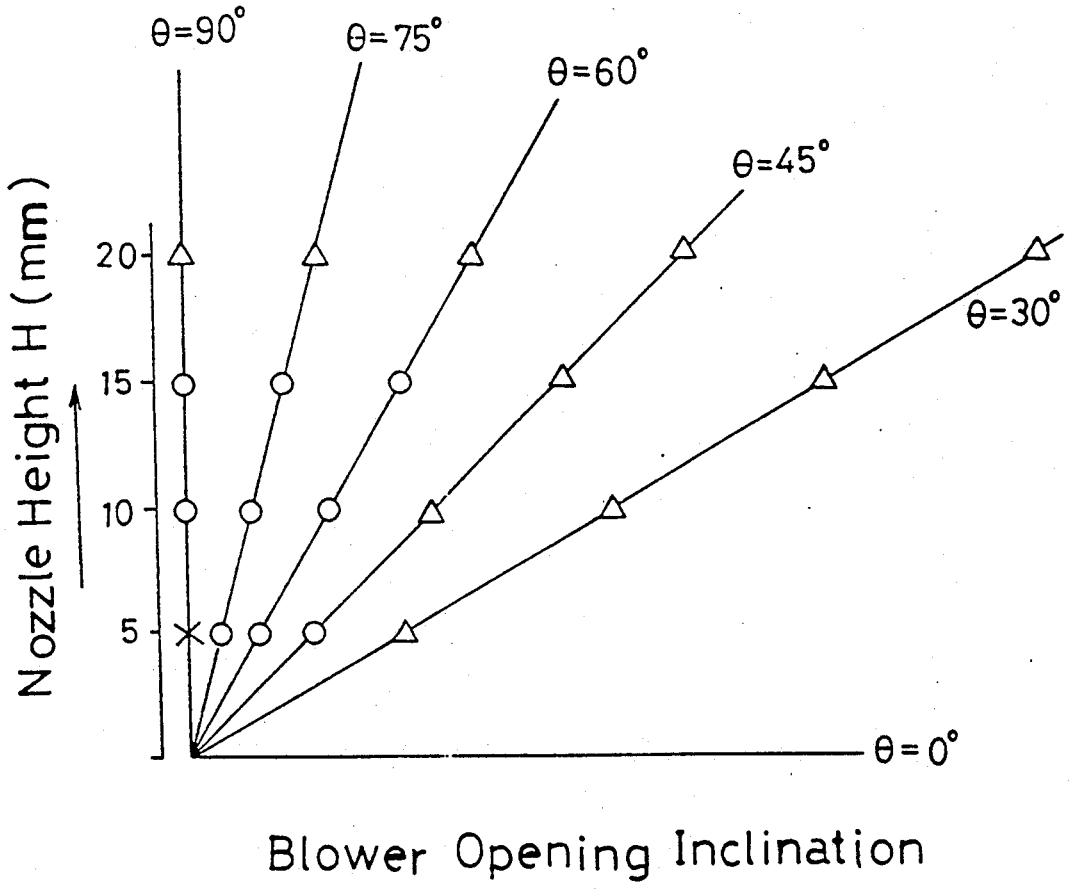
FIG. 9 is a view illustrating results of experiments on an altitude or height and orientation of a blower opening.

In FIG. 9, the inclination ($\theta$) denotes the angular position of the blower openings *7a* relative to the floor face; thus, the inclination ($\theta$) of 90 degrees means that the blower opening *7a* is positioned normal to the floor face.

The floor coating liquid applying machine shown in FIGS. 1 through 3 is adapted to receive electric power for the operation from a wall electricity outlet available at a work site. Instead, it is also conceivable to adapt the machine to be operated by a battery power, so that the machine can move about more freely without the physical restriction of the electic cable. This alternate arrangement using a battery is advantageous also in that control of the electric current and voltage can be easily adjusted to desired values for appropriately controlling the temperature and velocity of the hot air.

Furthermore, it is also conceivable to provide another air (blower) opening for feeding air of room temperature so that the hot air and the room-temperature air can be used in combination depending on the varied necessities.

The invention may be embodied in other specific forms without departing from the spirit or essential. characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What in claimed is:

1. A machine for applying a liquid floor coating onto a floor surface, said machine comprising:

a machine body having means for propelling said machine body along said floor surface in a propelling direction;

a liquid feed device movably mounted on said machine body for feeding a floor coating liquid to said floor surface;

a liquid applying member attached to said machine body for applying said floor coating liquid onto said floor surface;

a feed pump attached to said liquid feed device for feeding said floor coating liquid from a liquid tank to said liquid feed device;

said liquid feed device reciprocating along a transverse direction of said machine body;

said feed pump including an elastic pump tube, said elastic pump tube connecting said tank and said liquid feed device, a rotary pump member operatively connected with said elastic pump tube, at least one feed portion disposed in a rotational manner on said rotary pump member, said at least one feed portion being operable in response to rotation of said rotary pump member to elastically deform said elastic pump tube to squeeze out said liquid floor coating contained therein into said liquid feed device; and at least one receiving portion disposed in an alternate arrangement with said at least one feed portion for causing said elastic pump tube to resile so as to introduce an additional quantity of said liquid floor coating from said liquid tank into said elastic upmp tube.

2. The machine for applying a liquid floor coating as defined in claim 1, wherein said machine body includes a blower having a blower opening, said blower opening feeding hot air onto said liquid floor coating, said blower opening being positioned rearwardly of said liquid applying member with respect to said propelling direction of said machine body.

3. The machine for applying a liquid floor coating as defined in claim 2, wherein said blower opening feeds hot air in a temperature range of 30 to 90 degrees Celsius and at a velocity in a range of about 40 to 100 m/sec.

4. A floor coating liquid applying machine comprising:

a liquid feed device for feeding floor coating liquid to a floor surface, said liquid feed device having means for reciprocating said liquid feed device in a direction transverse with respect to a propelling direction of said machine;

a liquid applying member for applying the floor coating liquid from said liquid feed device onto the floor surface;

a propelling vehicle body having means for propelling said body in said propelling direction, said vehicle body having said liquid feed device and said liquid applying member mounted thereon;

a feed pump attached to said liquid feed device for feeding the floor coating liquid from a liquid tank;

a blower having a blower opening and attached to said machine body feeds hot air rearwardly of said liquid applying member with respect to the propelling direction of said vehicle body.

5. The machine for applying a liquid floor coating as defined in claim 4, wherein said blower opening is positioned with a rearward inclination in a range of 60 to 90 degrees relative to the floor face and at a height not less than 5 mm but not more than 20 mm.

6. A machine for applying a liquid floor coating onto a floor surface, said machine comprising:

a liquid feed device for feeding said floor coating liquid to said floor surface;

a liquid applying member for applying the floor coating liquid onto the floor surface;

a propelling machine body having means for propelling said machine body in a propelling direction having said liquid feed device and said liquid applying member mounted thereon;

a feed pump for feeding the floor coating liquid from a liquid tank to said liquid feed device;

a blower having a blower opening provided rearwardly of said liquid applying member and attached to the machine body to feed hot air onto said floor surface rearwardly of said liquid applying member with respect to the propelling direction in a temperature range of 30 to 90 degrees Celsius and at a velocity of about 40 to 100 m/sec; and wherein said liquid feed device has means for reciprocating said liquid feed device along a transverse direction of the machine body.

7. The machine for applying a liquid floor coating as defined in claim 1, wherein said liquid feed device includes a liquid feed nozzle connected to a nozzle feed tube, said liquid feed nozzle further being connected to a rotary shaft reciprocating said liquid feed nozzle in a transverse direction with respect to the propelling of said machine body along said floor surface.

8. The machine for applying a liquid floor coating as defined in claim 7, wherein said rotary shaft has a spiral groove placed thereon, said spiral groove of said rotary shaft engaging a casing mounted on said rotary shaft to which is connected said liquid feed nozzle.

9. The machine for applying a liquid floor coating as defined in claim 8, wherein said casing is further mounted to a guide rail extending parallel with respect to said rotary shaft, said guide rail preventing said casing and said liquid feed nozzle from rotating about said rotary shaft.

10. The machine for applying a liquid floor coating as defined in claim 1, wherein said liquid applying member is connected to a drive, said drive device being powered to both rotate and vertically oscillate said liquid applying member relative to said floor surface.

11. The machine for applying a liquid floor coating as defined in claim 10, wherein said drive device is connected to a link member, said link member in turn connecting to a switching lever for selectively moving said liquid applying member into contact or away from said floor surface.

* * * * *